US008572765B2

(12) United States Patent
Tao

(10) Patent No.: US 8,572,765 B2
(45) Date of Patent: Nov. 5, 2013

(54) THIN FILM GLOVES

(75) Inventor: Jian Tao, Reno, NV (US)

(73) Assignee: Foodhandler, Inc., Reno, NV (US)

( * ) Notice: Subject to any disclaimer, the term of this patent is extended or adjusted under 35 U.S.C. 154(b) by 379 days.

(21) Appl. No.: 12/923,198

(22) Filed: Sep. 8, 2010

(65) Prior Publication Data

US 2012/0054943 A1 Mar. 8, 2012

(51) Int. Cl.
*A41D 19/00* (2006.01)

(52) U.S. Cl.
USPC ..... 2/167

(58) Field of Classification Search
USPC ..... 2/167, 169
See application file for complete search history.

(56) References Cited

U.S. PATENT DOCUMENTS 3,625,790 A 12/1971 Ayres
3,681,784 A * 8/1972 Lindley ..... 2/162
3,683,420 A * 8/1972 Vilain ..... 2/161.7
3,866,245 A 2/1975 Sutherland
4,082,862 A * 4/1978 Esemplare et al. ..... 427/133
4,329,312 A 5/1982 Ganz
4,476,588 A 10/1984 Long
4,740,545 A 4/1988 Ohachi
4,842,781 A * 6/1989 Nishizawa et al. ..... 264/1.35
4,928,322 A 5/1990 Bradfield
5,644,798 A * 7/1997 Shah ..... 2/167
5,725,867 A 3/1998 Mixon
5,906,823 A 5/1999 Mixon
6,016,570 A 1/2000 Vande Pol et al.
7,137,148 B2 11/2006 Tao et al.
2005/0015848 A1 1/2005 Junjie
2007/0026028 A1 2/2007 Close et al.
2009/0193563 A1 * 8/2009 Junjie ..... 2/167

* cited by examiner

*Primary Examiner* — Katherine Moran
(74) *Attorney, Agent, or Firm* — Husch Blackwell LLP

(57) ABSTRACT

A single use disposable glove utilizing the cutting and sealing process. The various layers of the glove are produced from an extrusion process made from a variety of materials including, but not limited to, polyvinyl chloride, polystyrene, polyurethane, polybutene, styrene-butadiene copolymers, ethylene-propylene copolymers, their mixtures and blends.

6 Claims, 1 Drawing Sheet

THIN FILM GLOVES

FIELD OF THE INVENTION

The present invention is directed to a method of producing a single use disposable glove using the cutting and sealing process.

BACKGROUND OF THE INVENTION

The most widely used element to protect an individual's hand during work or other endeavors would be a glove. Historically, gloves were produced utilizing a large number of different processes as well as various sorts of materials depending on the variety of applications.

For example, gloves used in gardening and in sports which would require the use of a heavy duty material would be made by sewing pieces of these materials together. These materials would include, but are not limited to leather, fabric, non-woven cloth and various combinations of these materials. Furthermore, these types of gloves were made to last through a number of repetitive usages. Additionally, the purpose of these types of gloves was to protect the user's hand and not necessarily other individuals.

Single use disposable gloves have been produced for utilization in, but not limited to medical procedures as well as for use in the food service industry. These types of single use gloves are employed to protect both the user as well as other individuals from contact with various germs or pathogens. Generally, these types of single use disposable gloves are manufactured using a dipping method or a cutting and heat sealing method.

The dipping method would employ a three dimensional hand shaped former which is introduced into a forming liquid compound. A portion of the forming liquid compound would adhere to the hand shaped former to produce a thin layer of film thereon. After this thin layer of film solidifies, the thin layer film would be stripped from the former, thereby producing a glove. This type of process is generally utilized to produce medical examination and surgical gloves, due to the fact that the combination of the three dimensional former would yield a glove which is relatively form fitting on the user's hand. This is due in part to the effective elasticity of the materials used during the dipping process. This form fitting characteristic of gloves produced by the dipping process is measured by applying stress to the glove for the purpose of deforming the glove and then releasing the glove from the stress. A measurement is then made as to whether the glove fully recovered to its original shape after being released from the stress. For example, utilizing a rubber glove formed from the dipping process, the deformation after a 100% stretch is less than 10%.

The dipping process employs a wide range of plastic and rubber polymers such as, but not limited to, natural rubber latex (NRL), carboxylated acrylonitrile butadiene copolymer (Nitrile), polyisoprene (PI), polychloroporene (Neoprene), polyurethane (PU), polyvinyl chloride (PVC) etc. as well as the various combinations produced via blending and copolymerization of these materials. A combination of these materials can be used from a blend of two or more of these compounds in a single dipping step. Conversely, a multiple dipping process producing a structured film provided with multiple layers can be employed. Generally, medical gloves produced by the dipping process would have a thickness of at least 0.08 mm for natural rubber latex or at least 0.05 mm for the aforementioned compounds. This parameter is required by the FDA and/or ASTM. Additionally, it is noted that it would be extremely difficult, if not impossible, to use the dipping process to produce films having a thickness of less than 0.05 mm without compromising the integrity of the produced film. Among the aforementioned materials, NRL, Nitrile and PVC would account for at least 95% of all commercially produced medical examination gloves. Table 1 lists the major attributes of these gloves.

TABLE 1

Typical properties of dipped PVC, NRL and Nitrile medical examination gloves

| Properties | PVC | NRL | Nitrile |
|---|---|---|---|
| Tensile Strength (MPA) | 11~15 | 18~25 | 20~40 |
| Elongation (%) | 300~400 | ~800 | ~600 |
| Deformation after 100% stretch (%) | 8~16 | ~5 | 5~10 |
| Thickness range (mm) | 0.06~0.10 | 0.08~0.12 | 0.06~0.12 |
| Weight (grams) | >5 | >5 | >4 |

While the physical properties of these gloves are quite different in terms of tensile strength and elongation, they also share quite some common characteristics such as thickness, weight, and deformation; after all, the application is the same, for medical examination.

Due to the fact that the combination of the three dimensional former and the minimal deformation, all these materials could yield very good form fitting articles. To characterize the form fitting parameter, a specimen is stressed to deform the article and is then the form is released to measure if the article could fully recover to its original shape. Quantitatively, the dumbbell specimen is stretched to 100% elongation and is held for ten seconds. The specimen is released and the length is immediately measured, as well as within ten seconds of the release. As the data in Table 1 is demonstrated, all the gloves have a deformation less than 10%, demonstrating that these gloves are form fitting gloves.

Another common characteristic is the fact that all of these gloves are thicker than 0.05 mm. On one hand, it is required by FDA regulations and ASTM standards for medical devices. On the other hand technically, it is also extremely difficult, if not impossible to dip films at thickness less than 0.05 mm without compromising film integrity severely.

Dipped gloves are mainly used as medical devices as well as commonly seen in food service industries. However, the majority of food service gloves are made via a cutting and sealing process. The prior art cutting and sealing process would utilize polymers extruded by, but not limited to, blowing, casting or calendaring the polymers into thin films. Two films would be laid upon each other on a flat surface. If a glove is to be produced, a metallic hand shaped knife constructed from, but not limited to, copper or stainless steel would be applied to the top of the first film to cut through both film layers. Since the hand shaped knife is also heated, the layers would be welded together along the cutting line as the films are cut to form one glove.

Table 2 illustrates the properties of a typical prior art food service glove manufactured by polyethylene (PE) using the cutting and sealing method.

TABLE 2

Typical properties of cut and sealed PE food service glove

| Properties | PE |
|---|---|
| Tensile Strength (MPa) | 11~15 |
| Elongation (%) | ~600 |
| Deformation after 100% stretch (%) | 30~50 |
| Thickness range (mm) | 0.01~0.02 |
| Weight (grams) | <2 |

Disposable gloves used in the food service industry are generally manufactured using this process. The most common material for this process is polyethylene. Due to the combination of producing the gloves using a two dimensional flat former and the plastic nature of polyethylene, in contradistinction to the gloves formed by the dipping process, the gloves produced by the cutting and sealing process are much less form fitting to the user's hand. As a matter of fact, these gloves are very baggy and clumsy for task performance. In terms of deformation after a 100% stretch of the produced gloves, in contrast to the 10% recovery of the materials generally used in the dipping process, the use of polyethylene would exhibit a deformation of 30%, or even 50%. Furthermore, since these gloves could have a thickness of less than 0.02 mm, the durability of these gloves is poor. Technically, to exclude thicker films is not a problem, but such a thick polyethylene glove would be very uncomfortable to wear and would be difficult to perform the required tasks needed in the food handling industry.

SUMMARY OF THE INVENTION

The deficiencies of the prior art are addressed by the present invention which describes a process of producing a single use disposable glove using the cutting and sealing process. This process would produce a glove having two or more layers with a thickness in the range of 0.02 mm to 0.06 mm. A number of polymeric materials would be used in place of the prior art use of polyethylene to produce single use disposable gloves employing the cutting and sealing method. These materials would include, but are not limited to, polyvinyl chloride, a polyolefin copolymer such as ethylene propylene copolymer. The use of these compositions would have a thickness between 0.02 mm to 0.06 mm and would have a much improved durability than the 0.02 mm polyethylene film produced by the prior art. More importantly, the use of these compositions in the cutting and sealing process would yield a glove having better elasticity than plastic polyethylene. This deformation would be between 10%-30% and, in some cases, even less than 10%, comparable to that of the rubbery articles produced by the dipping method. The film quality using the various extrusion techniques would outperform a glove produced by the dipping process, not only in integrity (pinhole rate) but also in a thickness profile (uniformity).

While in theory a dipping process could also yield multiple layered structures via multiple dipping steps, in reality in the marketplace, it is rare to find a commercially viable glove that is made of two layers of different materials, or use different formulations. As a matter of fact, almost all gloves made via a double dipping process do not use different materials, or different formulations. This is because different materials may require quite different mechanisms and conditions to cure, but the dipping line conditions are always the same. In the case that a double dipping process employed two different formulations or materials, those would form the inner and outer surface of the resulted glove. Since the dipped article forms one piece, there is no way to have such a case that the palm and the back are made from different formulations or materials.

This invention can produce gloves 1 that have much more complicated structures than a dipping process. First of all, it is easy to create multiple layered structured films using co-extrusion, For a thin film, it is common to have triple layers or more, not to mention only two layers. Secondly, since the glove seals two separate films, 10 and 15, upon each other with one side 15 being the palm and the other side 10 being the back, one can produce a glove with the palm and back made from different materials. Furthermore, due to the fact that two separate films 10 and 15 could be produced in different machines, one can easily produce a glove 1 having the palm of one thickness and the back of another thickness. Therefore, one can increase the palm thickness for durability improvement whereas lower the thickness of the back for cost reduction. Consistent with the fact that the thicknesses of the two separate films are different, the weight of each of the films could also he different. For example, one of the layers could account for 50%~70% of the total glove weight, whereas the second layer would encompass 30%~50% of the total glove weight.

In terms of thickness control, the dipping process usually yields a broad range of thicknesses. For most of the glove, if the palm or cuff thickness is desired to be 0.06 mm, the entire thickness profile over the surface of the glove could be anywhere between 0.05 mm to 0.10 mm. This should be compared to the extruded film utilized in the cutting and sealing process which would allow the thickness control position to be much better. If the desired thickness is 0.06 mm, the glove can easily be manufactured having a profile narrower than 0.055 to 0.065 mm, or even ± 0.002 mm, which could not be produced using the prior art dipping process.

DETAILED DESCRIPTION OF THE INVENTION

Figure 1:
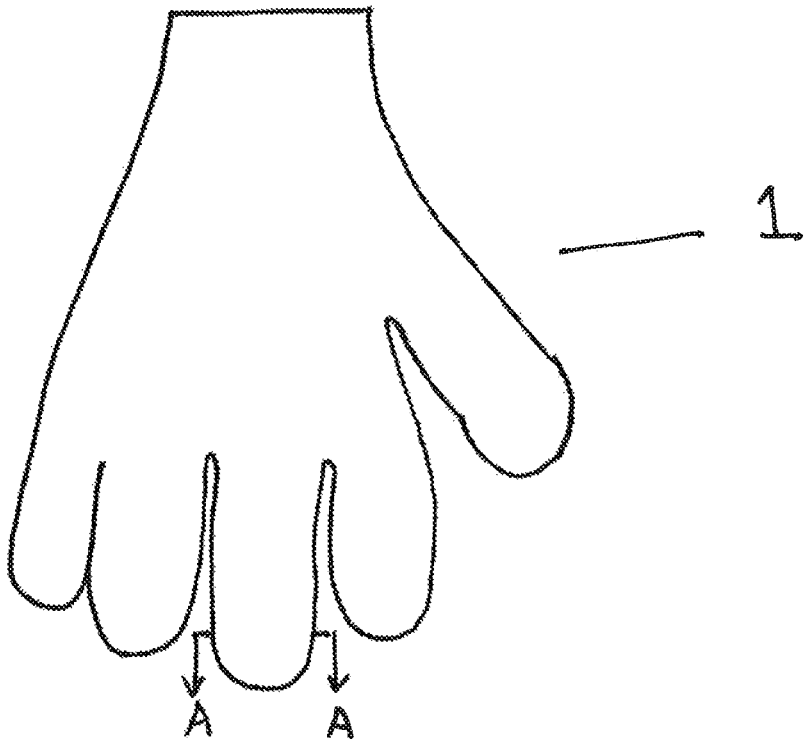
FIG. 1 shows the glove in the shape of a hand.
Figure 2:
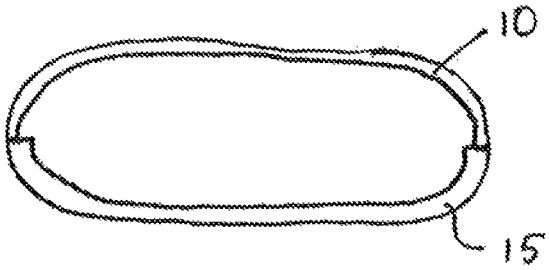
FIG. 2 shows a cross-sectional view of the glove along the line A-A

The present invention overcomes the poor plastic deformation after stress produced by the prior art cutting and sealing process employing polyethylene to produce the multiple layers of the glove. This is accomplished by utilizing a family of thermoplastic elastomers such as, but not limited to, polyvinyl chloride, polystyrene, polyurethane, polybutene, styrene-butadiene copolymers, ethylene-propylene copolymers, their mixtures as well as there blends. The use of these compositions for one, both, or additional film layers would produce a glove having a thickness in the range of 0.02 mm to 0.05 mm with excellent film integrity, but also good elasticity, thereby reducing hand fatigue. With improved hand shape, not only would the glove be classified as truly form fitting, but it would also exhibit improved durability as well as increased thickness without increasing the weight.

Comparing the materials used in the present invention with the dipping technology, in addition to film quality and reduced thickness, the utilization of the cutting and sealing process employing the films produced by the above-listed compositions, would provide for a more versatile film structure, as well as glove material selection. For example, utilizing polyvinyl chloride to make a plastisol compound suitable for the manufacture of a glove using the dipping process, very limited choices on plasticized selections can be made. This is true, for example, since the dipping compound must be liquid at room temperature. More critically, the material that is utilized must have a viscosity at a certain range for thickness and film tensile strength optimization. Using the cutting and sealing approach, the film forming extrusion process could be produced but not limited to blowing, casting or calendaring. Since the extrusion machine would be able to utilize a solid resin, there is no limit on the viscosity, since one can even utilize non-liquid form plasticizers.

The following examples would illustrate the present invention as compared to a prior art glove using polyvinyl chloride in the dipping process as well as the prior art glove produced by polyethylene using the cutting and sealing process.

Example 1

Polyvinyl Chloride and Phthalates Plasticizer

Traditionally, utilizing a polyvinyl chloride liquid compound that is suitable for producing a glove employing the dipping process, viscosity and boiling point requirements prohibited the choices of plasticizers tremendously. Among the many families of plasticizers, dialkyl phthalates are most widely adopted. This is a very highly controversial situation since there are concerns about their effect on health and food contact, most noticeably utilizing diethylhexyl phthalate (DEHP). However, using an extruder to produce films employed in the cutting and sealing process, the requirement for plasticizers is much more flexible. Not only can one choose a non-conventional plasticizer such as citrates, adipates and polyesters, even for the same plasticizers, the use of extrusion to produce the film layers could adopt a much wider plasticizer range because of no limit on the viscosity. As a result of that, a polyvinyl chloride glove produced by the cutting and sealing process could be more flexible or durable depending upon its intended application.

As one of the most widely used thermoplastic materials, polyvinyl chloride has been used far beyond the medical examination glove industry. However, whether used in the glove industry or not, the most widely plasticizer used with polyvinyl chloride is diethylhexyl phthalate (DEHP) or dioctyl phthalate (DOP) family. This combination shows excellent heat sealability used in the cutting and sealing process. Table 3 illustrates the properties of heat sealed PVC/DEHP gloves. This table shows the use of different thicknesses of the glove. However, the composition of each of the gloves is the same.

TABLE 3

Properties of cut and heat sealed PVC/DEHP gloves

| Properties | PVC 1 | PVC 2 |
|---|---|---|
| Tensile Strength (MPa) | ~15 | ~15 |
| Elongation (%) | ~340 | ~340 |
| Deformation after 100% stretch (%) | ~11 | ~11 |
| Thickness range (mm) | 0.040 ± 0.002 | 0.060 ± 0.002 |
| Weight (grams) | 2.7 | 3.5 |
| Phthalates Content (%) | 50 | 50 |

It is certainly not surprising that the characteristics of the gloves illustrated in Table 3 showed almost the identical tensile strength, elongation and deformation of the gloves illustrated in Table 1 produced by the dipping method. This is due to the fact that these properties are largely influenced by the particular formulations. Film formation process has little impact on these parameters. This is obviously true with the PVC glove shown in Table 1. However, it is quite important that the gloves shown in Table 3 are noticeably lighter than the gloves shown in Table 1. Even at a thickness of 0.060 mm, the gloves shown in Table 3 are much lighter than the gloves shown in Table 1. The PVC glove illustrated in Table 1 is greater than 5 grams. This is contrasted to the PVC gloves illustrated in Table 3 having a weight of 2.7 or 3.5 grams. It would be impossible to produce an overall weight of 3.5 grams for a PVC glove using the dipping process. Clearly it would be even more difficult to produce a PVC glove from the dipping process having a weight of 2.7 grams without compromising film integrity. Furthermore, since the PVC gloves shown in Table 3 are lighter than the PVC as well as NRL and Nitrile gloves shown in Table 1, less material is used, producing a savings in the cost of producing the glove. It is noted that the formulation of the PVC1 and PVC2 gloves in Table 3 area identical. The only differences between these two gloves are the amount of material in one or more layers of film to produce gloves having different thicknesses or weight.

Even comparing with conventional polyvinyl chloride gloves, the gloves produced by the present invention is more environmentally friendly. There is no fusing at high temperature needed, resulting in only a small amount of plasticizers released into the atmosphere, thereby creating a more energy efficient system. Additionally, the polyvinyl glove produced by the present invention insures a more healthy working environmental condition to the worker's using the gloves as well as reducing fire hazard dangers. Furthermore, since the PVC gloves shown in Table 3 were much lighter than those gloves shown in Table 1, they will be more comfortable when used by the workers.

Example 2

Polyvinyl Chloride without Phthalates Plasticizers

As previously described in Example 1, DEHP has been used as a plasticizer with polyvinyl chloride. However, since there are concerns about the use of DEHP as a plasticizer, Example 2 employs a polyvinyl chloride liquid compound without phthalate plasticizers. Even though PVC glove manufacturers using the dipping method have steadily migrated from the use of DEHP, the plasticizer choices are still confined to the phthalates family mostly using diisononyl phthalate (DINP) as the alternative to DEHP.

Using a film forming extrusion process such as, but not limited to blowing, casting or calendaring, the requirement for plasticizers is more flexible. Various non-conventional plasticizers such as, but not limited to adipates, citrates, azelates, phosphates, trimellitates, chlorinated paraffin as well as their combinations via mixing can be used. Even for the same plasticizers, extrusion could adopt a much wider plasticizer range because of no limit on viscosity. As a result, a polyvinyl chloride glove made from the cutting and sealing process could be more flexible or durable dependent upon the intended applications. Table 4 lists the properties of two PVC gloves produced by the cutting and sealing process without the use of phthalates.

TABLE 4

Properties cut and heat sealed phthalates free PVC gloves

| Properties | PVC 3 | PVC 4 |
|---|---|---|
| Tensile Strength (MPa) | 15 | 20 |
| Elongation (%) | 340 | 278 |
| Deformation after 100% stretch (%) | 11 | 12 |
| Thickness range (mm) | 0.040 ± 0.002 | 0.040 ± 0.002 |
| Weight (grams) | 2.7 | 2.7 |
| Phthalates Content (%) | N/A | N/A |

Without the limitation on the viscosity of plasticizer choices, it is possible to produce a PVC glove with tensile strength that is comparable with that of natural rubber latex at 20 MPa. Furthermore, since no phthalates have been used, this glove is more environmentally friendly as well as less hazardous to the user. A standard thermal stabilizer is always used in a PVC glove. However, the thermal stabilizer does not have any impact on the sealing procedure. Generally, the thermal stabilizer would be approximately 1 or 2% of the composition. For example, PVC3 uses a trimellitate family of plasticizers and PVC4 used an adipate family of plasticizers.

Example 3

Ethylene Propylene Copolymer (EPC)

Generally, as previously described, gloves used in the food service industry are predominantly constructed from polyethylene. These films are formed using either a blowing or casting process prior to employing the cutting and sealing process. Typically, the thickness of these gloves is purposely controlled to be less than 0.02 mm. If the glove is thicker than 0.02 mm, plastic polyethylene can be quite tough. Not only is it impossible to form the application as desired, but it could also quickly cause hand fatigue. As a result of thin thickness, the polyethylene gloves produced by the cutting and sealing process were not durable. As a matter of fact, most of these gloves were disposed in several minutes.

The present invention utilizing a glove produced by an ethylene propylene copolymer film is almost as flexible as the glove produced by rubbery materials. Additionally, at a thickness of between 0.030 and 0.060 mm, it is soft and comfortable without causing finger fatigue after one hour of use, as well as being durable.

Table 5 shows a comparison of the present invention using two ethylene propylene copolymers produced by the cutting and sealing process.

TABLE 5

Properties of EPC cut and sealed gloves

| Properties | EPC 1 | EPC 2 |
|---|---|---|
| Tensile Strength (MPa) | 22 | 21 |
| Elongation (%) | 577 | 618 |
| Deformation after 100% stretch (%) | 11 | 12 |
| Thickness range (mm) | 0.045 ± 0.002 | 0.060 ± 0.002 |
| Weight (grams) | 2.5 | 3.1 |

Comparing the two EPC gloves shown in Table 5 with a conventional polyethylene glove formed by the cutting and sealing process, the glove produced by the present invention is more environmentally friendly. Approximately the same amount of materials would be used to produce the EPC glove according to the present invention with respect to the polyethylene glove. However, the glove according to the present invention has a greater thickness than the conventional polypropylene glove thereby creating a glove which is more durable. EPC1 and EPC2 have a high propylene content of between 70 and 90%. The difference between EPC1 and EPC2 is the amount of material used in one or more of the films, thereby producing a glove (EPC2) which is thicker and heavier than EPC1.

Example 4

Ethylene Propylene Copolymer (EPC)

By choosing a variety of ethylene propylene copolymers (EPC) with different ethylene to propylene ratios, it is possible to produce a glove having vastly different performance characteristics. In terms of thickness deformation, a glove can be produced having as low as less than 10% deformation after 100% stretch which is comparable to rubbery materials to almost 30% completely plastic materials. It is possible to produce a glove having a thickness of 0.04 mm which is still comfortable to be utilized. Properties of additional EPC gloves produced by additional EPC copolymers are shown in Table 6. EPC3 and EPC4 have a high ethylene content of between 70 and 90%. The difference between EPC3 and EPC4 is the amount of material used in one or more of the films. More material is used in the EPC3 gloves, thereby producing a glove which is thicker and heavier than the EPC4 glove.

TABLE 6

Properties of EPC cut and sealed gloves

| Properties | EPC 3 | EPC 4 |
|---|---|---|
| Tensile Strength (MPa) | 16 | 15 |
| Elongation (%) | 725 | 688 |
| Deformation after 100% stretch (%) | 20 | 28 |
| Thickness range (mm) | 0.040 ± 0.002 | 0.025 ± 0.002 |
| Weight (grams) | 2.5 | 1.5 |

Comparing these EPC gloves with a conventional polyethylene glove, the EPC gloves are more environmentally friendly and use virtually the same amount of materials while producing a more durable glove. EPC gloves to not include either a thermal stabilizer or a plasticizer.

Comparing the present invention utilizing an ethylene propylene copolymer with that of polyvinyl chloride using the dipping process, this embodiment of the present invention is certainly more environmentally friendly since no phthalate plasticizer is being used. Additionally, with almost the same amount of materials used, the present invention would last much longer than the glove produced by the cutting and sealing process employing polyethylene.

The process of producing a single use disposable glove employing the cutting and sealing process with the inventive compositions will now be explained. The films used to produce the glove using the cutting and sealing process will be produced by an extrusion process such as, but not limited to, blowing, casting and calendaring. The films would be planar in nature and each of the films would be placed on top of one another on a flat surface. Although two films are generally used to produce the single use disposable glove, it is possible to use a plurality of films. Once the planar films are placed on top of one another, a template knife in the shape and size of the glove is placed on the top surface and pressure is applied to cut these films in the shape of the applied template and, since the template is heated, the two or more layers would be welded together to form the glove. As can be appreciated, the cuff of the glove would not be welded together allowing an opening for the placement of the user's hand within the produced glove.

As can be appreciated, each film layer can be produced by the different compositions, blends or mixtures of the materials to be used in the cutting and sealing process as previously described. The determination of the composition of each of the films would be based upon the use to which each glove would be directed.

While particular embodiments and applications of the present invention have been illustrated and described, it is to be understood that the invention is not limited to the precise construction and compositions disclosed herein and that various modification, changes, and variations may be apparent from the foregoing descriptions without departing from the spirit and scope of the invention as defined in the appended claims.

What is claimed is:

1. A single use disposable glove, comprising:

at least one top layer comprising a layer of planar thermoplastic elastomer film in the form of a hand;

at least one bottom layer comprising a layer of planar thermoplastic elastomer film in the form of a hand, wherein a portion of the periphery of said at least one bottom layer is sealed to a portion of the periphery of said at least one top layer to form a glove;

wherein an opening is provided between said at least one top layer and said at least one bottom layer for the insertion of a human hand between said at least one top layer and said at least one bottom layer, and further wherein a thickness of said at least one top layer and said at least one bottom layer is between 0.03 mm and 0.06 mm and the thickness of said at least one bottom layer is greater than the thickness of said at least one top layer, wherein said at least one top layer of planer thermoplasic elastomer film consists essentially of an ethylene-propylene copolymer wherein the ethylene or propylene content of the ethylene-propylene copolymer is from 70% to 90% and said at least one bottom layer of planar thermoplastic elastomer film consists essentially of an ethylene-propylene copolymer wherein the ethylene or propylene content of the ethylene-propylene copolymer is from 70% to 90%.

2. The glove in accordance with claim 1, wherein a weight of said at least one top layer and said at least one bottom layer is approximately 30%-70% of the total glove weight.

3. The glove in accordance with claim 1, wherein said at least one top layer and said at least one bottom layer include DEHP as a plasticizer.

4. The glove in accordance with claim 1, wherein said at least one top layer and said at least on bottom layer includes citrates, adipates, azelates, phosphates, trimellitates, chlorinated paraffin, or polyesters as a plasticizer.

5. A single use disposable glove, comprising:

at least one top layer comprising a planar thermoplastic elastomer film in the form of a hand having a first thickness;

at least one bottom layer comprising a planar elastomer film in the form of a hand having a second thickness greater than said first thickness, wherein a portion of a periphery of said at least one bottom layer is sealed to a portion of a periphery of said at least one top laver, forming a glove;

wherein, an opening is provided between said at least one top layer and said at least one bottom layer for the insertion of a human hand between said at least one top layer and said at least one bottom layer, and further wherein, the weight of the glove is between 1.5 grams and 3.1 grams, wherein said at least one top layer of planar thermoplastic elastomer film consists essentially of an ethylene-propylene copolymer wherein the ethylene of propylene content of the ethylene-propylene copolymer is from 70% to 90% and said at least one bottom layer of planar thermoplastic elastomer film consists essentially of an ethylene-propylene copolymer wherein the ethylene of propylene content of the ethylene-propylene copolymer is from 70% to 90%.

6. A single use disposable glove, comprising:

at least one top layer comprising a planar thermoplastic elastomer film in the form of a hand having a first thickness;

at least one bottom layer comprising a planar thermoplastic elastomer film in the form of a hand having a second thickness greater than said first thickness, a portion of a periphery of said at least one bottom layer sealed to a portion of a periphery of said at least one top layer, forming a glove;

wherein, an opening is provided between said at least one top layer and said at least one bottom layer for the insertion of a human hand between said at least one top layer and said at least one bottom layer, and further wherein. deformation of a formed glove is between 10% and 30% after a 100% stretch, wherein said at least one top layer of planar thermoplastic elastomer film consists essentially of an ethylene-propylene copolymer wherein the ethylene or propylene content of the ethylene-propylene copolymer is from 70% to 90% and said at least one bottom layer of planar thermoplastic elastomer film consists essentially of an ethylene-propylene copolymer wherein the ethylene or propylene content of the ethylene-propylene copolymer is from 70% to 90%.

* * * * *